US008040285B2

(12) United States Patent
Shimo et al.

(10) Patent No.: US 8,040,285 B2
(45) Date of Patent: Oct. 18, 2011

(54) GLASS ANTENNA FOR AN AUTOMOBILE

(75) Inventors: Kenichiro Shimo, Chiyoda-ku (JP); Mitsuro Watanabe, Chiyoda-ku (JP); Masaki Ito, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 460 days.

(21) Appl. No.: 12/251,570

(22) Filed: Oct. 15, 2008

(65) Prior Publication Data

US 2009/0096690 A1 Apr. 16, 2009

(30) Foreign Application Priority Data

Oct. 15, 2007 (JP) ..... 2007-268222

(51) Int. Cl.
*H01Q 1/32* (2006.01)

(52) U.S. Cl. ..... 343/713

(58) Field of Classification Search ..... 343/711–713
See application file for complete search history.

(56) References Cited

U.S. PATENT DOCUMENTS

| | | | | |
|---|---|---|---|---|
| 4,803,492 | A * | 2/1989 | Inaba et al. | 343/713 |
| 5,499,034 | A * | 3/1996 | Fujii et al. | 343/713 |
| 6,229,493 | B1 * | 5/2001 | Iijima | 343/713 |
| 7,456,796 | B2 * | 11/2008 | Nagayama et al. | 343/713 |

FOREIGN PATENT DOCUMENTS

| | | | |
|---|---|---|---|
| EP | 0856904 | A2 * | 8/1998 |
| EP | 1 763 105 | A1 | 3/2007 |

OTHER PUBLICATIONS

U.S. Appl. No. 12/169,136, filed Jul. 8, 2008, Shimo, et al.

* cited by examiner

*Primary Examiner* — Huedung Mancuso
(74) *Attorney, Agent, or Firm* — Oblon, Spivak, McClelland, Maier & Neustadt, L.L.P.

(57) ABSTRACT

A glass antenna for an automobile improving antenna gain is provided.

The glass antenna can receive two wavelength bands, that are a first wavelength band and a second wavelength band higher than the first wavelength band, and provided that the first wavelength band is designated as H band and the second wavelength band is designated as L band, antenna conductors 6, 7 for H band each having a shape and dimension configured to receive H band is provided on a rear glass plate 10 for an automobile, and an antenna conductor 1 for L band having a shape and dimension configured to receive L band is provided on the rear window glass plate 10, the antenna conductors 6, 7 for H band and the antenna conductor 1 for L band constitute two types of antenna conductors, the antenna conductor 1 for L band has a portion extending in a predetermined direction, and provided that the portion is designated as a predetermined direction extending portion 1*c*, the predetermined direction extending portion 1*c* has a detour portion 1*b*.

20 Claims, 4 Drawing Sheets

GLASS ANTENNA FOR AN AUTOMOBILE

TECHNICAL FIELD

The present invention relates to a glass antenna for an automobile suitable to receiving Japanese terrestrial digital TV broadcasting (470 to 770 MHz), analogue TV broadcasting in UHF band (473 to 767 MHz) or U.S. digital TV broadcasting (698 to 806 MHz).

BACKGROUND ART

Heretofore, a high frequency wave antenna for an automobile to receive digital TV broadcast band wave shown in FIG. 6 is reported in WO2006/001486. In this prior art example, a defogger constituted by a plurality of heater wires 43 and bus bars 45 is provided on a rear window glass plate 10, and an antenna conductor 41 and a feeding point 42 are provided. A uppermost heater wire right under the antenna conductor 41 has a meander shape. In this construction, in a digital TV broadcast band, influence of heater wires 43 and 44 to the antenna conductor 41 is reduced, and the antenna gain in the digital TV broadcast band is improved.

However, in this prior art example, since the heater wire 44 at the highest position is too long, its resistance per a unit length need to be reduced. Accordingly, the line width of the heater wire 34 at the highest position becomes too wide, and there has been a problem that the width of the heater wire 34 at the highest position prevents visibility.

DISCLOSURE OF THE INVENTION

Problems to be Solved by the Invention

It is an object of the present invention to provide a glass antenna for an automobile which solves the above-mentioned problem of prior arts.

Means to Solve the Problems

The present invention provides a glass antenna for an automobile which can receive at least two wavelength bands that are a first wavelength band and a second wavelength band, which comprises at least two types of antenna conductors provided on a window glass plate of an automobile, wherein the first wavelength band is a higher wavelength band than the second wavelength band, the first wavelength band is designated as a H band and the second wavelength band is designated as a L band, wherein one or a plurality of antenna conductors for H band having a shape and a dimension configured to receive the H band is provided on the window glass plate, an antenna conductor for L band having a shape and a dimension configured to receive the L band is provided on the window glass plate, and the antenna conductor for H band and the antenna conductor for L band constitute the above at least two types of antenna conductors, and wherein the antenna conductor for L band has a portion extending in a predetermined direction, and provided that the portion is designated as a predetermined direction extending portion, the predetermined direction extending portion has a detour portion.

Effects of the Invention

In the present invention, by employing the above construction, it is possible to reduce influences of an antenna conductor for L band and other antenna conductors other than an antenna conductor for H band that are provided on a glass window plate, on an antenna conductor for H band, and to improve antenna gain at a time of receiving the terrestrial digital TV broadcast in Japan or the digital TV broadcast in U.S. etc. Further, in a rear window glass plate provided with a defogger, the present invention hardly deteriorates the view field of the rear window, particularly, the view field and beauty of the defogger region. Further, since the length of the antenna conductor for L band becomes long, it becomes possible to improve antenna gain at a time of receiving L band such as the AM broadcast band.

EXPLANATION OF NUMERALS

Figure 1:
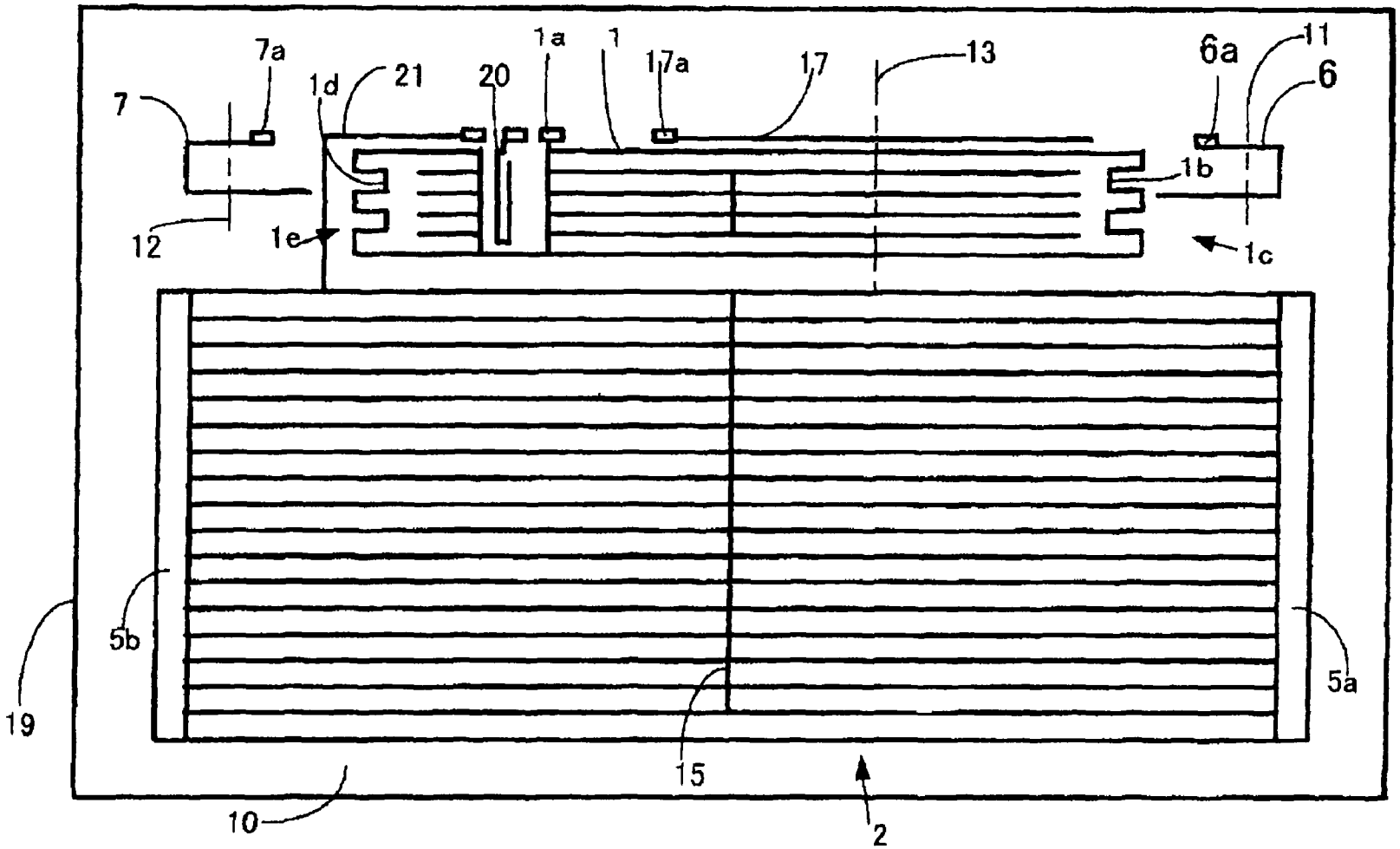
FIG. 1: A plan view showing an embodiment of glass antenna for an automobile of the present invention.

1: Antenna conductor for L band
1*a*: Feeding point for antenna conductor for L band
1*b*, 1*d*: Bypass portion
1*c*: First predetermined direction extending portion
1*e*: Second predetermined direction extending portion
2: Heater wire
5*a*, 5*b*: bus bar
6: First antenna conductor for H band
6*a*: Feeding point of first antenna conductor for H band
7: Second antenna conductor for H band
7*a*: Feeding point of second antenna conductor for H band
10: Rear window glass plate
11: First H imaginary plane
12: Second H imaginary plane
13: L imaginary plane
15: Short circuit wire
17: Main antenna conductor for FM broadcast band
17*a*: Feeding point of main antenna conductor 17
19: Body opening edge for window
20: Antenna conductor for keyless entry
21: Subantenna conductor for FM broadcast band

BEST MODE FOR CARRYING OUT THE INVENTION

Now, the glass antenna of an automobile of the present invention is described in detail with reference to preferred embodiments shown in the attached drawings. FIG. 1 is a plan view showing an embodiment of the glass antenna for an automobile of the present invention. Here, FIG. 1 shows a view from a car-interior sides but it may be a view from a car-exterior side.

In FIG. 1, 1 is an antenna conductor for L band, 1*a* is a feeding point of an antenna conductor for L band, 1*b* and 1*d* are detour portions, 1*c* is a first predetermined direction extending portion, 1*e* is a second predetermined direction extending portion, 2 is a heater wire, 5*a* is a first bus bar, 5*b* is a second bus bar, 6 is a first antenna conductor for H band, 6*a* is a feeding point of the first antenna conductor 6 for H band, 7 is a second antenna conductor for H band, 7*a* is a feeding point of the second antenna conductor 7 for H band, 10 is a rear window glass plate, 11 is a first H imaginary plane, 12 is a second H imaginary plane, 13 is a L imaginary plane, 15 is a short circuit wire, 17 is a main antenna conductor for FM broadcast band, 17*a* is a feeding point of the main antenna conductor 17, 19 is a body opening edge for window, 20 is an antenna conductor for keyless entry, and 21 is a subantenna conductor for FM broadcast band.

From now, in the description of the present invention, FIG. 1 shows predetermined direction extending portions that are a first predetermined direction extending portion 1*c* and a second predetermined direction extending portion 1*e*, but the first predetermined direction extending portion 1*c* is used as an example in the following description. In FIG. 1, the body opening edge 19 for window is an edge of an opening of a body to which the rear window glass plate 10 is fitted, which functions as body earth, and the edge is made of an electrically conductive material such as a metal. Here, in FIG. 1 and Figures showing various embodiments, a direction means a direction in the drawing. In the example shown in FIG. 1, the main antenna conductor for FM broadcast band, the antenna conductor 20 and the subantenna conductor 21 are not directly related to the present invention.

In the present invention, a window glass plate of an automobile is provided with at least two antenna conductors capable of receiving at least two wavelength bands that are a first wavelength band and a second wavelength band. The first wavelength band is a wavelength band higher than the second wavelength band. Provided that the first wavelength band is designated as H band and the second wavelength band is designated as L band, one or a plurality of antenna conductors for H band having a shape and dimension configured to receive the H band is provided on the window glass plate. Further, an antenna conductor for L band having a shape and a dimension configured to receive the L band is provided on the glass plate. In this case, the antenna conductor for H band and the antenna conductor for L band constitute the above at least two types of antenna conductors. In the example shown in FIG. 1, the H band is the digital TV broadcast band, the L band is the AM broadcast band, and the window glass plate is a rear window glass plate 10.

In the example shown in FIG. 1, a rear window glass plate 10 is provided with a plurality of heater wires 2, a plurality of bus bars 5*a* and 5*b* for supplying electricity to the plurality of heater wires 2. The plurality of heater wires 2 and the bus bars 5*a* and 5*b* constitute a defogger. The plurality of heater wires 2 extends in a lateral direction or a substantially lateral direction, and antenna conductor 6 and 7 for H band are provided in a right side region and a left side region in the upper space region of the rear window glass plate 10 that are regions other than the region of defogger. However, the construction is not limited thereto, and the antenna conductor for H band may be provided in at least one of the right side region and the left side region in the upper space region of the rear window glass plate 10. Further, in the central region of the upper space region of the rear window glass plate, that is other than the region of defogger, an antenna conductor 1 for L band is provided.

The antenna conductor 1 for L band has a portion extending in a predetermined direction, and when the portion is designated as a first predetermined direction extending portion 1*c*, the first predetermined direction extending portion 1*c* has a detour portion 1*b*. In the example shown in FIG. 1, the first predetermined direction extending portion 1*c* extends in a vertical direction or a substantially vertical direction. Assuming that FIG. 1 is a car-exterior view, the shape of the detour portion 1*b* has an angular U-shape or a substantially angular U-shape, and such a construction is preferred since it improves antenna gain. However, the construction is not limited thereto, and the shape may be a V-shape or a substantially V-shape, and the shape is not particularly limited.

Provided that the wavelength at the central frequency in the H band in the air is designated as $\lambda_0$, the glass wavelength shrink rate is designated as k, and equations k=0.64 and $\lambda_g$ (wavelength in the glass)=$\lambda_0 \cdot k$ are satisfied, then, it is preferred that the maximum width (the maximum width in left-right direction in the example of FIG. 1) of the detour portion in a direction perpendicular to the longitudinal direction of the first predetermined direction extending portion 1*c* is from $0.178\lambda_g$ to $0.323\lambda_g$ for the purpose of improving antenna gain. This maximum width is described in Table 1.

TABLE 1

| | $\lambda_g$-normalized maximum width | Maximum width when H band is Japanese terrestrial digital TV broadcast |
|---|---|---|
| Preferred range | 0.178 $\lambda_g$ to 0.323 $\lambda_g$ | 55 to 100 mm |
| More preferred range | 0.194 $\lambda_g$ to 0.308 $\lambda_g$ | 60 to 95 mm |
| Particularly preferred range | 0.226 $\lambda_g$ to 0.308 $\lambda_g$ | 70 to 95 mm |
| Most preferred range | 0.252 $\lambda_g$ to 0.297 $\lambda_g$ | 78 to 92 mm |

The maximum width of the detour portions 1*b* and 1*d* in the longitudinal direction (vertical direction in the example of FIG. 1) of the first predetermined direction extending portion 1*c*, is preferably from $0.032\lambda_g$ to $0.097\lambda_g$, particularly preferably from $0.052\lambda_g$ to $0.078\lambda_g$ for the purpose of improving antenna gain. When the H band is the terrestrial digital TV broadcast in Japan, the maximum width is preferably from 10 to 30 mm, particularly preferably from 16 to 24 mm for the purpose if improving antenna gain.

In the example of FIG. 1, a plurality of detour portions 1*b* are provided, and the shape of the first predetermined direction extending portion 1*c* having the detour portions 1*b* is meander shape or substantially meander shape. Employment of such a construction is preferred for the purpose of improving antenna gain. However, the shape is not limited thereto, and the shape of the first predetermined direction extending portion 1*c* is not necessarily a meander shape or substantially meander shape.

The cycle of the plurality of detour portions 1*b* is preferably from $0.065\lambda_g$ to $0.194\lambda_g$ for the purpose of improving antenna gain. When the H band is the terrestrial digital TV broadcast in Japan, the cycle is preferably from 20 to 60 mm for the purpose of improving antenna gain.

The first predetermined direction extending portion 1*c* is provided in the first antenna conductor 6 for H band side from the center or the gravity center of the antenna conductor 1 for L band. Employment of such an embodiment is preferred for the purpose of improving antenna gain.

A plane in parallel with the longitudinal direction and the vertical direction of an automobile, which contains the center or the gravity center of the first antenna conductor for H band, is assumed, and the plane is designated as a first H imaginary plane 11. Further, a plane in parallel with the longitudinal direction and the vertical direction of the automobile, which contains the center or the gravity center of the antenna conductor 1 for L band, is assumed, and the plane is designated as a L imaginary plane 13. In this condition, the detour portion 1*b* is preferably provided between the first H imaginary plane 11 and the L imaginary plane 13, for the purpose of improving antenna gain.

Figure 2:
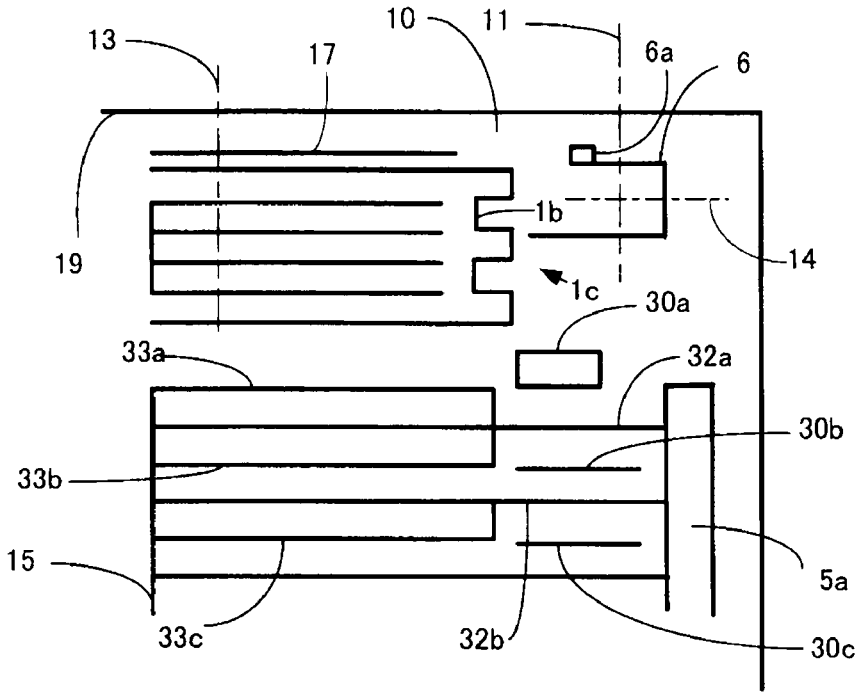
FIG. 2: A plan view showing another embodiment different from that of FIG. 1.

FIG. 2 (car-interior view or car-exterior view) shows another embodiment different from that of FIG. 1. FIG. 2 shows only an upper right region of a rear window glass plate 10, and other regions are omitted. In the example of FIG. 2, the structure of defogger is different from that of FIG. 1, in that island conductors 30*a*, 30*b* and 30*c* are provided in the embodiment of FIG. 2. A defogger is symmetric or substantially symmetric with respect to left-right center line of the rear window glass plate 10. Here, in the present invention, an island conductor means a conductor not connected with an antenna conductor in terms of conduction of DC current, an island conductor has a concept including a loop-shaped conductor, and the shape of island conductor is not particularly limited.

FIG. 2 does not show a part of an antenna conductor 1 for L band, antenna conductors 20 and 21, a second antenna conductor 7 for H band and a second bus bar 5*a*, that are shown in FIG. 1. When a line passing through the center or the gravity center of the antenna conductor 6 for H band and parallel with an uppermost heater wire (corresponding to an uppermost original heater wire 32*a* in the example of FIG. 2) is assumed, and the line is designated as an imaginary parallel line 14, then, an island conductor 30*a* is provided in a region of the rear window glass plate 10 between the imaginary parallel line 14 and the uppermost heater wire when they are observed three-dimensionally. Employment of such an embodiment is preferred for the purpose of improving antenna gain. Further, "observed three-dimensionally" means to observe from a direction perpendicular to a plane of the rear window glass plate 10 in a region where the island conductor is provided.

In the example of FIG. 2, one island conductor 30*a* is provided. However, the construction is not limited thereto, and a plurality of island conductors 30*a* may be provided. Further, the island conductor 30*a* has a shape of loop-shaped rectangle or substantially rectangle. Employment of such an embodiment is preferred for the purpose of improving antenna gain. However, the embodiment is not limited thereto, and the shape may be a polygon, a substantially polygon, a circle, a substantially circle, an ellipse, a substantially ellipse or a linear shape etc. other than a rectangle.

In the example of FIG. 2, a first antenna conductor 6 for H band is provided in the right side region of the upper space region, and although not shown, a second antenna conductor for H band is provided in the left side region of the upper space region. Further, in the central region of the upper space region, an antenna conductor 1 for L band is provided. A plane in parallel with a plane parallel with the longitudinal direction and the vertical direction of an automobile, which contains the left-right center or the gravity center of the first antenna conductor 6 for H band, is assumed, and the plane is designated as a first H imaginary plane 11. Further, a plane in parallel with a plane parallel with the longitudinal direction and the vertical direction of the automobile, that contains the left-right center or the gravity center of the second antenna conductor for H band, is assumed, and the plane is designated as a second H imaginary plane.

A first bus bar 5*a* is provided in a right side region of the rear window glass plate 10, and a second bus bar is provide din a left side region of the rear window glass plate 10. The first bus bar 5*a* and the second bus bar are each extends in a vertical direction or a substantially vertical direction. Further, a heater wire extending from the uppermost portion or the vicinity of the uppermost portion of the first bus bar 5*a* toward the left-right center of the rear window glass plate 10 and reaching and connected to the uppermost portion or the vicinity of the uppermost portion of the second bus bar, is designated as an uppermost original heater wire 32*a*.

The uppermost original heater wire 32*a* has at least one branch heater wire branched from the uppermost original heater wire 32*a* in the middle between the first H imaginary plane and the left-right center of the rear window glass plate 10.

The branch heater wire branched from the uppermost original heater wire 32*a* once extends and turns to a direction in parallel or substantially parallel with the uppermost original heater wire 32*a*, and extends towards the left-right center of the rear window glass plate 10. Further, the branch heater wire turns to be merged and connected with the uppermost original heater wire 32*a* at a position before the uppermost original heater wire 32*a* passes through the second H imaginary plane. Employment of such an embodiment is preferred for the purpose of improving antenna gain for H band. Here, FIG. 2 only shows the first bus bar 5*a* and second bus bar, but a bus bar other than the first bus bar 5*a* and the second bus bar may be provided.

In the Example of FIG. 2, a branch heater wire 33*a* is disposed above the uppermost original heater wire 32*a*. Further, a branch heater wire 33*b* is disposed under the uppermost original heater wire 32*a*.

A heater wire in the vicinity of the first bus bar 5*a* and in the vicinity of the second bus bar, that is right under the uppermost original heater wire 32*a*, and that extends from the first bus bar 5*a* towards the left-right center of the rear window glass plate 10 and reaches and is connected with the second bus bar, is designated as a second original heater wire 32*b*. The second original heater wire 32*b* has a branch heater wire 33*c* branched from a portion of the second original heater wire 32*b* from the first bus bar 5*a* through the first H imaginary plane 11 to the left-right center of the rear window glass plate 10, and the branch heater wire 33*c* once extends downwardly or substantially downwardly, turns in a lateral direction or substantially lateral direction towards the left-right center of the rear window glass plate 10, and turns upward or substantially upward to merge and is connected with a portion of the second original heater wire 32*b* before the original heater wire 32*b* passes through the second H imaginary plane.

Also not shown in FIG. 2, the second original heater wire 32*b* may have a branch heater wire branched from a portion of the second original heater wire 32*b* from the first bus bar 5*a* through the first H imaginary plane 11 to the left-right center of the rear window glass plate 10, and branch heater wire once extends upwardly or substantially upwardly, turns in a lateral direction or substantially lateral direction towards the left-right center of the rear window glass plate 10, and turns downwardly or substantially downwardly to merge and is connected with a portion of the second original heater wire 32*b* before the original heater wire 32*b* passes through the second H imaginary plane.

Under the first antenna conductor 6 for H band and between the uppermost original heater wire 32*a* and the second original heater wire 32*b*, one or a plurality of island conductors may be provided. In the example of FIG. 2, a linear-shaped island conductor 30*b* is provided in this area. Further, under the second antenna conductor for H band and between the uppermost original heater wire 32*a* and the second original heater wire 32*b*, one or a plurality of island conductors may be provided.

In the example of FIG. 2, under the first antenna conductor 6 for H band and between the second original heater wire 32*b* and an underside heater wire, a linear-shaped island conductor 30*c* is provided. Further, although not shown in FIG. 2, under the second antenna conductor for H band and between the second original heater wire 32*b* and the underside heater wire, a linear-shaped island conductor may be provided.

In the present invention, the main portion of an island conductor preferably has a linear shape or a substantially linear shape in order to maintain visibility. Here, the island conductor may contain a conductor other than a linear-shaped conductor. Here, a linear-shaped conductor means a conductor having a line width of at most 3 mm.

In order to satisfactorily receive entire region of the terrestrial digital TV broadcast band in Japan (470 to 770 MHz), $\lambda_0$ corresponding to the wavelength at the central frequency 620 MHz of the terrestrial digital TV broadcast band in Japan, becomes 483.9 mm, and $\lambda_g$ becomes 309.7 mm.

In order to satisfactorily receive current broadcast frequency band (470 to 600 MHz) in the terrestrial digital TV broadcast band in Japan, $\lambda_0$ corresponding to the wavelength at the central frequency 535 MHz of this present broadcast frequency band becomes 561 mm, and $\lambda_g$ becomes 359 mm.

In order to satisfactorily receive main broadcast band (470 to 710 MHz) in the terrestrial digital TV broadcast band in Japan, $\lambda_0$ corresponding to the wavelength at the central frequency 590 MHz of this main broadcast band, becomes 508 mm, and $\lambda_g$ becomes 325 mm.

Considering antifogging effect and visibility, the distance between heater wires 2 is preferably from 10 to 40 mm. It is more preferably from 22 to 34 mm, particularly preferably from 25 to 32 mm. Intervals of heater wires provided on the rear window glass plate 10 are preferably constant or substantially constant to uniformly exhibit antifogging effect.

In the present invention, the H band is preferably the terrestrial digital TV broadcast in Japan, digital TV broadcast in U.S., digital TV broadcast in China or digital TV broadcast in Europe.

When the digital TV broadcast in Japan is received, the H band preferably contains a frequency present between 470 and 770 MHz. When present broadcast frequency band of the terrestrial digital TV broadcast in Japan is received, the H band preferably contains a frequency present between 471 and 600 MHz. When the digital TV broadcast in U.S. is received, the H band preferably contains a frequency present between 698 and 806 MHz.

In the example of FIG. 1, any one of the bus bars 5*a* and 5*b* is electrically connected with an anode of a DC power source, and the other one of the bus bars is electrically connected with a cathode of the DC power source. In the example of FIG. 1, two bus bars 5*a* and 5*b* are provided on a rear window glass plate 10. However, the construction is not limited thereto, and many bus bars such as three or four bus bars may be provided. Namely, the present invention can be applied to a defogger in which a voltage is applied between two bus bars in the antenna conductor side. Here, the short circuit wire 15 is provided for adjusting impedance of the defogger as the case requires.

In the present invention, the rear window glass plate 10 is preferably tilted from the horizontal direction by from 18 to 36°, particularly preferably from 20 to 33° to improve antenna gain.

In the present invention, island conductors, bus bars, heater wires, short circuit wires, antenna conductors and feeding points are usually formed by printing a car-interior side surface of an window glass plate with a past containing an electrically conductive metal such as a silver paste, and baking them. However, the method is not limited thereto, and these elements may be formed by forming a linear-shaped members or foil-shaped members made of an electrically conductive material such as copper on a car-interior side surface or a car-exterior side surface of the window glass plate, or by embedding these members in the window glass plate itself. The antenna conductors 6 and 7 for H band and the feeding points 6*a* and 7*a* may be formed by embedding them in a synthetic resin film or providing them on such a film, and by providing such a synthetic resin film on the window glass plate.

In the Example of FIG. 1, the antenna conductors 6 and 7 for H band are each monopole antenna having one feeding point. However, the construction is not limited thereto, and the antenna conductors 6 and 7 for H band may be each a dipole antenna having one feeding point and an earth conductor (not shown). In the present invention, the feeding point provided for an antenna conductor is preferably provided at a position above or obliquely above the antenna conductor for the purpose of improving antenna gain.

In the present invention, it is preferred to carry out diversity receiving between the first antenna conductor 6 for H band and the second antenna conductor 7 for H band. This is to make antenna performance as nondirectional as possible. Further, the number of antenna conductors provided on a vehicle other than the antenna conductors 6 and 7 for H band is not particularly limited, and diversity receiving may be carried out between the antenna conductors 6, 7 and other antenna conductors such as a pole antenna, and/or between the antenna conductors 6, 7 for H band and another glass antenna.

AM broadcast band is usually employed as L band. However, the L band is not limited thereto, and it may be a longer wavelength band or shorter wavelength band.

Examples

The present invention will be described below with reference to drawings, but the present invention is not limited to these examples, and various improvements or modifications are also included in the present invention so long as they do not depart from the gist of the present invention.

Figure 3:
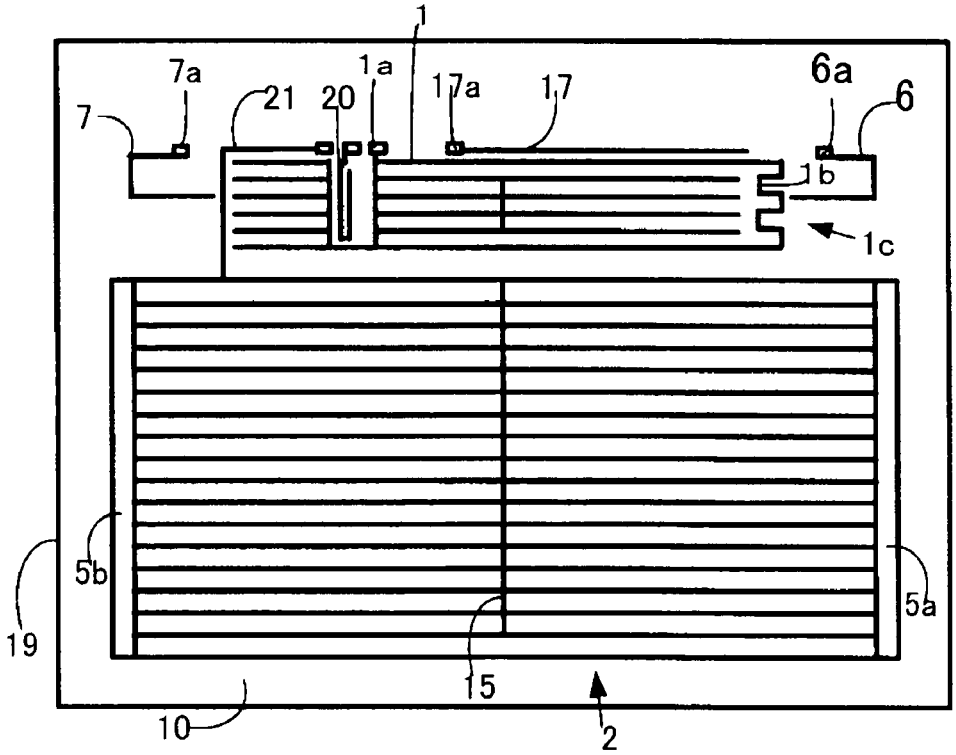
FIG. 3: A plan view showing an example.
Figure 4:
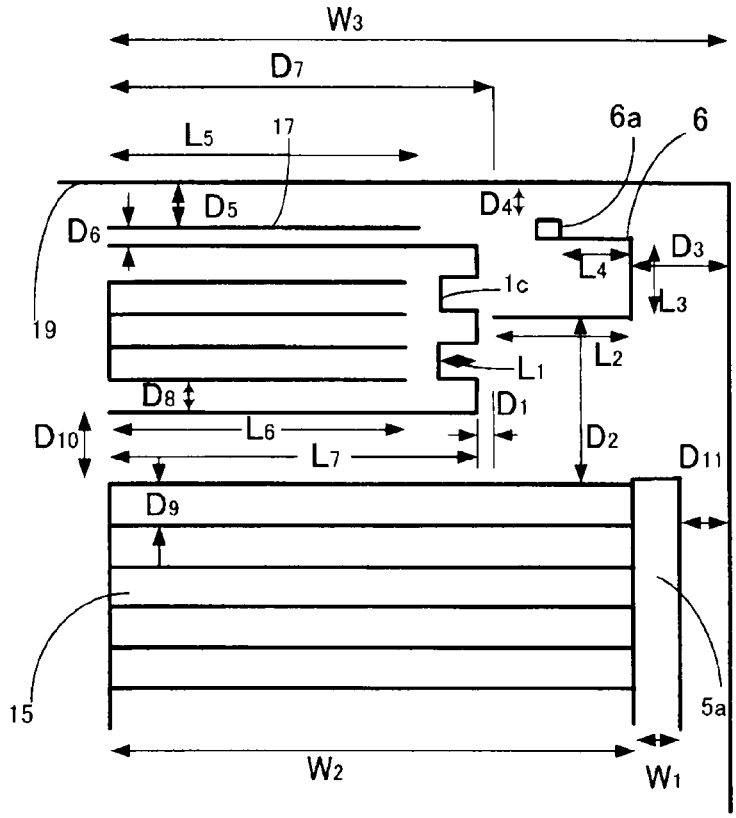
FIG. 4: A plan view showing upper right region of rear window glass plate 10 shown in FIG. 3.

From now, the present invention will be described in detail with reference to drawings. Employing a rear window glass plate 10 attached to an automobile, a glass antenna for an automobile shown in FIGS. 3 and 4 (car-interior view) was produced. FIG. 4 shows an upper right region of the rear window glass plate 10 shown in FIG. 3, and the rear window glass plate 10 is 22° tilted from the horizontal direction. Dimensions of portions are shown below.

Measurement was made with respect to horizontal polarization. Antenna gain is defined as an average value of antenna gains at 30 intervals within a horizontal direction range of from −90° to +90° (automobile back side) provided that the automobile rear direction is designated as 0°, the automobile left direction is designated as +90°, and the automobile front direction is designated as +180°. The frequencies for calculation are 6 MHz intervals in a range of from 473 to 713 MHz. For the calculation of average antenna gain, area-average calculation method was applied. With respect to the characteristics view to be described later, the above definition of measurement of F/B ratio is applied.

Figure 5:
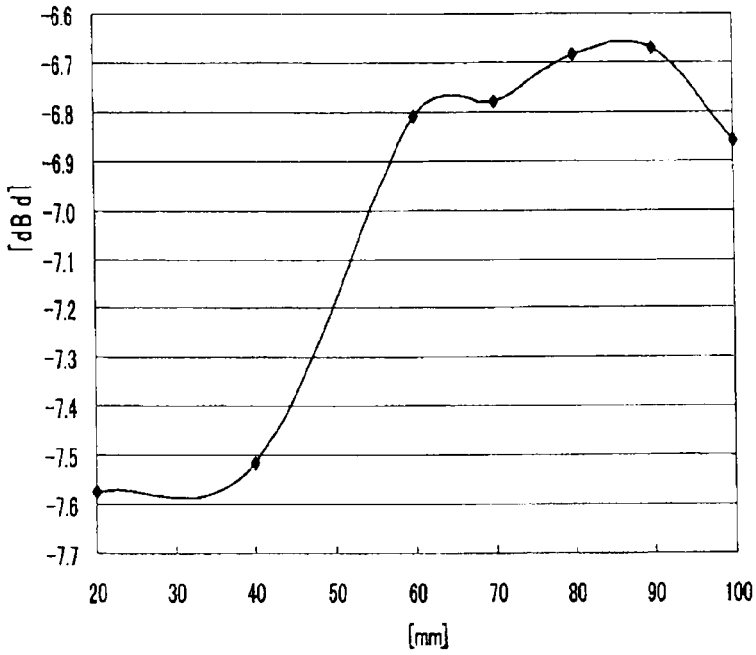
FIG. 5: A characteristic view of antenna gain when $L_1$ is in a range of from 20 to 100 mm in the example.
Figure 6:
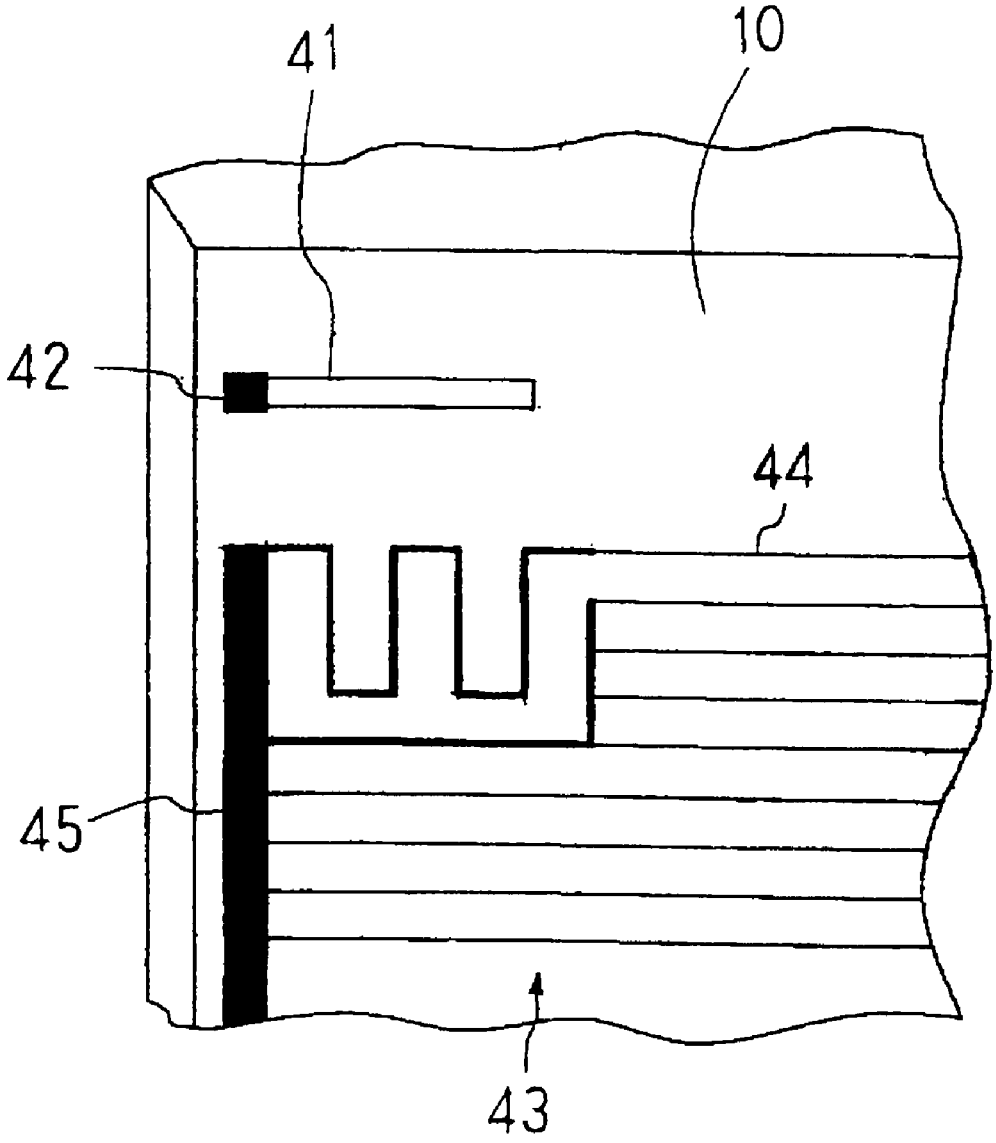
FIG. 6: A front view showing a conventional example.

At various $L_1$ values within a range of from 20 to 100 mm, antenna gain was measured and FIG. 5 shows the result. In FIG. 5, −7.0 dBd corresponds to $L_1$=0 mm that corresponds to a Comparative Example where no detour portion 1*b* is provided and the first predetermined direction extending portion 1*c* has a linear shape. Here, since $L_6=L_7-L_1-10$ mm is satisfied, $L_6$ changes according to change of $L_1$.

| | |
|---|---|
| Rear window glass plate 10 | 800 × 1360 mm, |
| Maximum vertical width of body opening edge 19 for window | 760 mm, |
| $L_2$ | 140 mm, |
| $L_3$ | 45 mm, |
| $L_4$ | 70 mm, |
| $L_5$ | 385 mm, |
| $L_7$ | 420 mm, |
| $D_1$ | 10 mm, |
| $D_2$ | 90 mm, |
| $D_3$ | 20 mm, |
| $D_4$ | 10 mm, |
| $D_5$ | 15 mm, |
| $D_6$ | 15 mm, |
| $D_7$ | 430 mm, |
| $D_8$ | 20 mm, |
| $D_9$ | 30 mm, |
| $D_{10}$ | 40 mm, |
| $D_{11}$ | 10 mm, |
| $W_1$ | 12 mm, |
| $W_2$ | 630 mm, |
| $W_3$ | 652 mm, |
| Feeding point 6a (vertical × horizontal) | 15 × 20 mm |

INDUSTRIAL APPLICABILITY

The present invention is used for a glass antenna for an automobile for receiving terrestrial digital TV broadcasting or analogue TV broadcasting in UHF band in Japan, digital TV broadcasting in U.S., digital TV broadcasting in EU region, or digital TV broadcasting in Peoples Republic of China. Further, the present invention is usable also for receiving FM broadcasting band in Japan (76 to 90 MHz), FM broadcast band in U.S. (88 to 108 MHz), VHF band for TV (90 to 108 MHz, 170 to 222 MHz), 800 MHz band for automobile phone (810 to 960 MHz), 1.5 GHz band for automobile phone (1.429 to 1.501 GHz), UHF band (300 MHz to 3 GHz), GPS (global positioning system), GPS signal of satellite (1,575.42 MHz), or VICS (vehicle information and communication system: 2.5 GHz).

Further, the present invention is usable for ETC communication ((trademark) Electronic Toll Collection system, that is a nonstop automatic toll collection system, in which transmission frequency of roadside wireless apparatus is 5.795 GHz or 5.805 GHz, and receiving frequency of roadside wireless apparatus is 5.835 GHz or 5.845 GHz), Dedicated Short Range Communication (DSRC, 915 MHz band, 5.8 GHz band, 60 GHz band), microwave (1 GHz to 3 THz), milliwave (30 to 300 GHz), automobile keyless entry system (300 to 450 MHz), and SDARS (Satellite Digital Audio Radio Service (2.34 GHz, 2.6 GHz)).

The entire disclosure of Japanese Patent Application No. 2007-268222 filed on Oct. 15, 2007 including specification, claims, drawings and summary is incorporated herein by reference in its entirety.

What is claimed is:

1. A glass antenna for an automobile which can receive at least two wavelength bands including a first wavelength band and a second wavelength band, comprising:

a window glass plate of an automobile;

at least two types of antenna conductors provided on the window glass plate of an automobile, wherein the first wavelength band is a higher wavelength band than the second wavelength band and is designated as a H band, and the second wavelength band is designated as a L band, the at least two types of antenna conductors comprising:

one or a plurality of antenna conductors for H band having a shape and a dimension configured to receive the H band and provided on the window glass plate, and an antenna conductor for L band having a shape and a dimension configured to receive the L band and provided on the window glass plate, wherein the antenna conductor for L band has a portion extending in a predetermined direction and designated as a predetermined direction extending portion, the predetermined direction extending portion having a plurality of the detour portions which form a meander shape or a substantially meander shape of the predetermined direction extending portion, and wherein the meander shaped portion and antenna conductor for H band are opposed to each other and separated by a predetermined distance.

2. The glass antenna for an automobile according to claim 1, wherein the shape of the detour portion is an angular U-shape, a substantially angular U-shape, a V-shape or a substantially V-shape observed from a car-interior side or a car-exterior side.

3. The glass antenna for an automobile according to claim 1, wherein the predetermined direction extending portion extends in a vertical direction or a substantially vertical direction, provided that the wavelength at the center frequency of the H band in the air is designated as $\lambda_0$, the glass wavelength shrink rate is designated as k, and that equations k=0.64 and $\lambda_g=\lambda_0 \cdot k$ are satisfied, then, the maximum width of the detour portion in a direction perpendicular to the longitudinal direction of the predetermined direction extending portion is from $0.178\lambda_g$ to $0.323\lambda_g$, and the maximum width of the detour portion in a direction in which the predetermined direction extending portion extends is from $0.032\lambda_g$ to $0.097\lambda_g$.

4. The glass antenna for an automobile according to claim 1, wherein the predetermined direction extending portion extends in a vertical direction or substantially vertical direction, and when the H band is the terrestrial digital TV broadcast in Japan, the maximum width of the detour portion in a direction perpendicular to the predetermined direction extending portion is from 55 to 100 mm, and the maximum width of the detour portion in a direction in which the predetermined direction extending portion extends is from 10 to 30 mm.

5. The glass antenna for an automobile according to claim 1, wherein provided that the wavelength at the central frequency of the H band in the air is designated as lamda0, the glass wavelength shrink rate is designated as k, and equations k=0.64 and lamdag=lamda0.k are satisfied, then, cycle of the plurality of detour portions forming the meander shape or the substantially meander shape is from 0.065 lamdag to 0.194 lamdag.

6. The glass antenna for an automobile according to claim 1, wherein the predetermined direction extending portion extends in a vertical direction or a substantially vertical direction, and provided that the H band is the terrestrial digital TV broadcast in Japan, the cycle of the plurality of detour portions forming the meander shape or the substantially meander shape is from 20 to 60 mm.

7. The glass antenna for an automobile according to claim 1, wherein the predetermined direction extending portion is provided in a side of the antenna conductor for H band from the center or the gravity center of the antenna conductor for L band.

8. The glass antenna for an automobile according to claim 1, wherein the window glass plate is a rear window glass plate, a plurality of heater wires and a plurality of bus bars for supplying electricity to the plurality of heater wires are provided on the rear window glass plate, the plurality of heater wires and the plurality of bus bars constitute a defogger, the plurality of heater wires extend in a lateral direction or substantially lateral direction, the antenna conductor for H band is provided on at least one of a right side region and a left side region in an upper space region of the rear window glass plate that is a region other than the defogger.

9. The glass antenna for an automobile according to claim 8, wherein provided that a line passing through the center or the gravity center of the antenna conductor for H band and parallel with an uppermost heater wire is designated as an imaginary parallel line, then, one or a plurality of island conductors are provided in a region of the rear window glass plate between the imaginary parallel line and the uppermost heater wire when they are three-dimensionally observed.

10. The glass antenna for an automobile according to claim 1, wherein the antenna conductor for H band comprises a first antenna conductor for H band provided in a right side region of the upper space region, and a second antenna conductor for H band provided in a left side region of the upper space region;

provided that a plane parallel with a plane parallel with a longitudinal direction and a vertical direction of the automobile, that is a plane passing through the left-right center or the gravity of the first antenna conductor for H band, is designated as a first H imaginary plane, and provided that a plane parallel with a plane parallel with a longitudinal direction and a vertical direction of the automobile, that is a plane passing through the left-right center or the gravity of the second antenna conductor for H band, is designated as a second H imaginary plane, then, the rear window glass plate is provided with a plurality of heater wires and first and second bus bars for supplying power to the plurality of heater wires, the first bus bar is provided in a right side region of the rear window glass plate, the second bus bar is provided in a left side region of the rear window glass plate, and the first bus bar and the second bus bar each extends in the vertical direction or the substantially vertical direction; and provided that among the heater wires, a heater wire extending from an uppermost portion or the vicinity of the uppermost portion of the first bus bar, extending towards the direction of left-right center of the rear window glass plate and reaching the uppermost portion or the vicinity of the uppermost portion of the second bus bar, is designated as an uppermost original heater wire, then, the uppermost original heater wire has at least one branch heater wire branched from a portion of the uppermost original heater wire between the first H imaginary plane and the left-right center of the rear window glass plate; the branch heater wire branched from the uppermost original heater wire extends and turns in a direction parallel or a substantially parallel with the uppermost original heater wire towards the left-right center direction of the rear window glass plate, and further, turns again to merge and connected with the uppermost original heater wire before the uppermost original heater wire passes through the second H imaginary plane.

11. The glass antenna for an automobile according to claim 1, wherein the antenna conductor for H band has a shape and dimension configured to receive the digital TV broadcast band.

12. The glass antenna for an automobile according to claim 1, wherein the antenna conductor for L band has a shape and dimension configured to receive the AM broadcast band.

13. The glass antenna for an automobile according to claim 1, wherein the H band contains a frequency present between 470 and 770 MHz.

14. A window glass plate for an automobile provided with at least the antenna conductor for H band and the antenna conductor for L band that are defined in claim 1.

15. The glass antenna for an automobile according to claim 10, wherein the predetermined direction extending portion extends in a vertical direction or substantially vertical direction, and when the H band is the terrestrial digital TV broadcast in Japan, the maximum width of the detour portion in a direction perpendicular to the predetermined direction extending portion is from 55 to 100 mm, and the maximum width of the detour portion in a direction in which the predetermined direction extending portion extends is from 10 to 30 mm.

16. The glass antenna for an automobile according to claim 10, wherein the predetermined direction extending portion extends in a vertical direction or a substantially vertical direction, and provided that the H band is the terrestrial digital TV broadcast in Japan, the cycle of the plurality of detour portions forming the meander shape or the substantially meander shape is from 20 to 60 mm.

17. The glass antenna for an automobile according to claim 10, wherein the predetermined direction extending portion is provided in a side of the antenna conductor for H band from the center or the gravity center of the antenna conductor for L band.

18. A glass antenna for an automobile which can receive at least two wavelength bands that are a first wavelength band and a second wavelength band, which comprises at least two types of antenna conductors provided on a window glass plate of an automobile, wherein the first wavelength band is a higher wavelength band than the second wavelength band, the first wavelength band is designated as a H band and the second wavelength band is designated as a L band, wherein one or a plurality of antenna conductors for H band having a shape and a dimension configured to receive the H band is provided on the window glass plate, an antenna conductor for L band having a shape and a dimension configured to receive the L band is provided on the window glass plate, and the antenna conductor for H band and the antenna conductor for L band constitute the above at least two types of antenna conductors, and wherein the antenna conductor for L band has a portion extending in a predetermined direction, and provided that the portion is designated as a predetermined direction extending portion, the predetermined direction extending portion has a detour portion, wherein the predetermined direction extending portion extends in a vertical direction or a substantially vertical direction, and provided that the wavelength at the center frequency of the H band in the air is designated as $\lambda_0$, the glass wavelength shrink rate is designated as k, and that equations $k=0.64$ and $\lambda_g=\lambda_0 \cdot k$ are satisfied, then, the maximum width of the detour portion in a direction perpendicular to the longitudinal direction of the predetermined direction extending portion is from $0.178\lambda_g$ to $0.323\lambda_g$, and the maximum width of the detour portion in a direction in which the predetermined direction extending portion extends is from $0.032\lambda_g$ to $0.097\lambda_g$.

19. A glass antenna for an automobile which can receive at least two wavelength bands that are a first wavelength band and a second wavelength band, which comprises at least two types of antenna conductors provided on a window glass plate of an automobile, wherein the first wavelength band is a higher wavelength band than the second wavelength band, the first wavelength band is designated as a H band and the second wavelength band is designated as a L band, wherein one or a plurality of antenna conductors for H band having a shape and a dimension configured to receive the H band is provided on the window glass plate, an antenna conductor for L band having a shape and a dimension configured to receive the L band is provided on the window glass plate, and the antenna conductor for H band and the antenna conductor for L band constitute the above at least two types of antenna conductors, and wherein the antenna conductor for L band has a portion extending in a predetermined direction, and provided that the portion is designated as a predetermined direction extending portion, the predetermined direction extending portion has a detour portion, wherein a plurality of the detour portions is provided in the predetermined direction extending portion, and the shape of the predetermined direction extending portion having the detour portions is a meander shape or a substantially meander shape, and wherein provided that the wavelength at the central frequency of the H band in the air is designated as $\lambda_0$, the glass wavelength shrink rate is designated as k, and equations $k=0.64$ and $\lambda_g=\lambda_0 \cdot k$ are satisfied, then, cycle of the plurality of detour portions forming the meander shape or the substantially meander shape is from $0.065\lambda_g$ to $0.194\lambda_g$.

20. A glass antenna for an automobile which can receive at least two wavelength bands that are a first wavelength band and a second wavelength band, which comprises at least two types of antenna conductors provided on a window glass plate of an automobile, wherein the first wavelength band is a higher wavelength band than the second wavelength band, the first wavelength band is designated as a H band and the second wavelength band is designated as a L band, wherein one or a plurality of antenna conductors for H band having a shape and a dimension configured to receive the H band is provided on the window glass plate, an antenna conductor for L band having a shape and a dimension configured to receive the L band is provided on the window glass plate, and the antenna conductor for H band and the antenna conductor for L band constitute the above at least two types of antenna conductors, and wherein the antenna conductor for L band has a portion extending in a predetermined direction, and provided that the portion is designated as a predetermined direction extending portion, the predetermined direction extending portion has a detour portion;

wherein the antenna conductor for H band comprises a first antenna conductor for H band provided in a right side region of the upper space region, and a second antenna conductor for H band provided in a left side region of the upper space region;

provided that a plane parallel with a plane parallel with a longitudinal direction and a vertical direction of the automobile, that is a plane passing through the left-right center or the gravity of the first antenna conductor for H band, is designated as a first H imaginary plane, and provided that a plane parallel with a plane parallel with a longitudinal direction and a vertical direction of the automobile, that is a plane passing through the left-right center or the gravity of the second antenna conductor for H band, is designated as a second H imaginary plane, then, the rear window glass plate is provided with a plurality of heater wires and first and second bus bars for supplying power to the plurality of heater wires, the first bus bar is provided in a right side region of the rear window glass plate, the second bus bar is provided in a left side region of the rear window glass plate, and the first bus bar and the second bus bar each extends in the vertical direction or the substantially vertical direction; and provided that among the heater wires, a heater wire extending from an uppermost portion or the vicinity of the uppermost portion of the first bus bar, extending towards the direction of left-right center of the rear window glass plate and reaching the uppermost portion or the vicinity of the uppermost portion of the second bus bar, is designated as an uppermost original heater wire, then, the uppermost original heater wire has at least one branch heater wire branched from a portion of the uppermost original heater wire between the first H imaginary plane and the left-right center of the rear window glass plate; the branch heater wire branched from the uppermost original heater wire extends and turns in a direction parallel or a substantially parallel with the uppermost original heater wire towards the left-right center direction of the rear window glass plate, and further, turns again to merge and connected with the uppermost original heater wire before the uppermost original heater wire passes through the second H imaginary plane.

* * * * *